United States Patent [19]

Hammer et al.

[11] 4,197,664

[45] Apr. 15, 1980

[54] STEAM IRON

[75] Inventors: Urs Hammer, Oberbuchsiten; Ernst Gisiger, Niederbuchsiten, both of Switzerland

[73] Assignee: Jura Elektroapparate-Fabriken L. Henzirohs A.G., Solothurn, Switzerland

[21] Appl. No.: 869,452

[22] Filed: Jan. 16, 1978

[30] Foreign Application Priority Data

May 9, 1977 [CH] Switzerland ..... 5780/77

[51] Int. Cl.[2] ..... D06F 75/06

[52] U.S. Cl. ..... 38/77.83

[58] Field of Search ..... 38/77.5, 77.6, 77.8, 38/77.81, 77.83, 3, 14, 77.7, 77.82; 68/5, 222; 100/73

[56] References Cited

U.S. PATENT DOCUMENTS

| | | | |
|---|---|---|---|
| 2,708,801 | 5/1955 | Voskresenski | 38/77.83 |
| 3,130,507 | 4/1964 | Hoecker | 38/77.5 |
| 3,599,357 | 8/1971 | Gronwick et al. | 38/77.83 X |
| 3,872,613 | 3/1975 | Davidson et al. | 38/77.83 |
| 4,149,327 | 4/1979 | Hammer et al. | 38/77.5 |
| 4,149,328 | 4/1979 | Hammer et al. | 38/77.83 |

FOREIGN PATENT DOCUMENTS

| | | | |
|---|---|---|---|
| 2046656 | 9/1970 | Fed. Rep. of Germany | 38/77.83 |

*Primary Examiner*—Louis Rimrodt

*Attorney, Agent, or Firm*—Zarley, McKee, Thomte, Voorhees & Sease

[57] ABSTRACT

A steam iron having an arrangement for producing a puff of steam, in which a duct between the water reservoir and the steam chamber, through which duct the water serving to produce the puff of steam passes into the steam chamber, can be opened and closed by a valve stem operatable from outside the steam iron.

5 Claims, 2 Drawing Figures

STEAM IRON

This invention relates to steam irons, and more particularly to a steam iron of the type having a water reservoir, a steam chamber, two ducts connecting the water reservoir to the steam chamber, and a movable valve stem capable of closing off one of the ducts.

Steam irons of this type are known in which the second duct is connected to a pump which, when operated, briefly causes additional water to enter the steam chamber for the purpose of producing a puff of steam. However, the pump required for this purpose is necessarily of a rather complicated construction. Moreover, it unavoidably tends to be somewhat trouble-prone in view of possible deposits of scale.

It is an object of this invention to provide an improved steam iron in which additional water is briefly caused to enter the steam chamber in a much simpler and more trouble-free manner than heretofore.

To this end, in the steam iron of the aforementioned type according to the present invention, the improvement comprises a further valve stem operatable from outside the steam iron and capable of closing off the other of the ducts.

Figure 1:
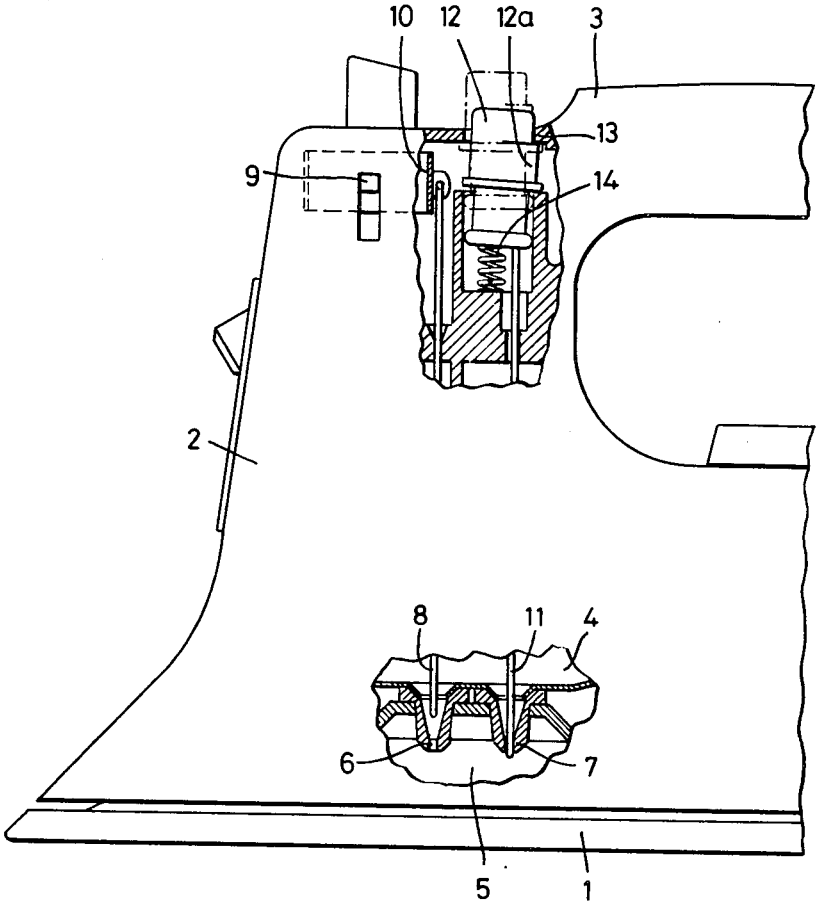
Figure 2:
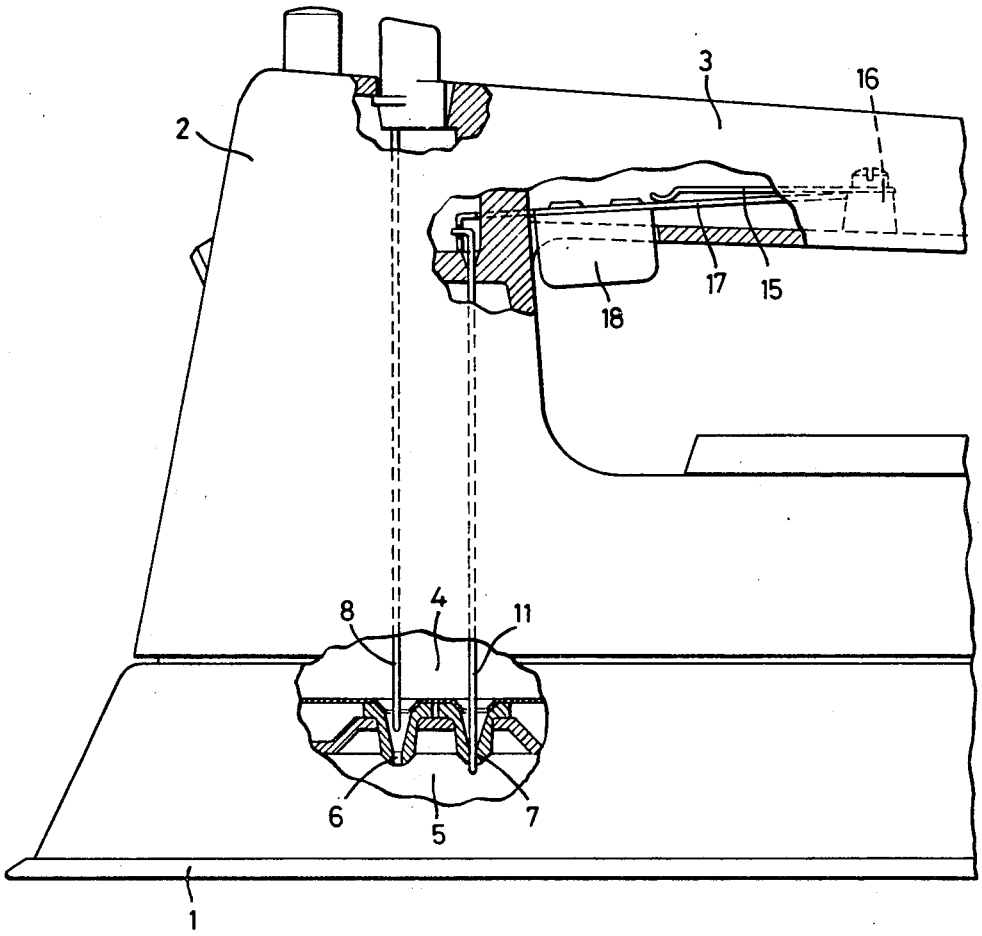

Two preferred embodiments of the invention will now be described in detail with reference to the accompanying drawings, in which:

FIG. 1 is an elevation, partially in section, of the front portion of a steam iron in a first embodiment of the invention, and FIG. 2 is an elevation analogous to FIG. 1 in a second embodiment.

The steam irons illustrated in the drawings each comprise a sole plate 1, a housing 2, a handle 3, a water reservoir 4, and a steam chamber 5. The reservoir 4 and the steam chamber 5 communicate with one another by means of a first duct 6 and a second duct 7. Inserted into the duct 6 is the lower end of a valve stem 8 which is linked to a slide 10 operated by means of a lever 9. The valve stem 8 and its actuating means 9 and 10 are used for starting up normal operation of the iron in that the duct 6 is opened up when the valve stem 8 is raised, so that water from the reservoir 4 can enter the steam chamber 5. The tip of the valve stem 8 is so designed, in a manner known per se, that it simultaneously serves to scrape off any scale which may be deposited in the duct 6. The second duct 7 is disposed in immediate proximity to duct 6 and likewise connects the reservoir 4 to the steam chamber 5. The duct 7 can be opened or closed by an axially movable valve stem 11.

In the embodiment illustrated in FIG. 1, the valve stem 11 is connected to a push button 12 projecting beyond the top of the housing 2 through an aperture 13 which is long enough to allow the push button 12 a certain amount of play in line with the longitudinal axis of the iron. When the push button 12 is in the position shown in solid lines in FIG. 1, the duct 7 is closed off by the valve stem 11. In that position, a shoulder **12*a* of the push button 12 is held beneath the lower edge of the aperture 13, against which it is pressed by a spring 14. Whenever it is desired to produce a puff of steam by briefly allowing additional water to enter the steam chamber 5 from the reservoir 4, it suffices to move the push button 12 forward, or towards the left as viewed in FIG. 1, so that the shoulder 12*a* is disengaged from the edge of the aperture 13. Owing to the biasing action of the spring 14, the push button 12, together with the valve stem 11, then moves up into the position indicated in dot-dash lines in FIG. 1, whereby the duct 7** is left open.

The second embodiment, illustrated in FIG. 2, differs from the first embodiment only in the manner in which the valve stem 11 is operated. Here the top of the valve stem 11 is linked to the free end of a one-armed lever 17 which is biased by a flat spring 15 and secured in the handle 3 by means of a screw 16. The lever 17 bears an operating member 18 projecting out of the handle 3. When the member 18 is pressed into the handle 3 against the bias of the spring 15, the valve stem 11 is lifted out of the position illustrated, in which it closes off the duct 7, into a position in which the duct 7 is left open to allow the passage of water for producing a puff of steam.

As concerns the mode of operation, the two embodiments described differ in that, in the first embodiment, the duct 7 is closed again by pressing the push button 12 back into the position shown in solid lines in FIG. 1, so that the shoulder **12*a* reengages the edge of the aperture 13 and is held there by the spring 14, whereas in the second embodiment, it suffices to release the operating member 18, and hence the lever 17, in order to return the valve stem 11 to the position in which it closes off the duct 7**.

Both embodiments make possible a decisive simplification in controlling the opening and closing of the second duct used for producing a puff of steam. As a result, the arrangement for producing an additional puff of steam is not only less trouble-prone but also considerably less expensive to manufacture.

What is claimed is:

1. A steam iron, comprising, a housing having a sole plate connected thereto to form a bottom surface for said iron, a single water reservoir within said housing, a single steam chamber within said housing, at least one steam outlet through said sole plate, said outlet being in communication with said steam chamber, a first duct connecting said water reservoir to said steam chamber, first valve means connected to said first duct to selectively open and close said first duct, a second duct connecting said water reservoir to said steam chamber, and a normally closed second valve means connected to said second duct to momentarily open said second duct to provide an amount of water to said steam chamber in addition to the amount of water provided through said first duct.

2. The device of claim 1 wherein said second valve means comprises, a valve stem movably mounted within said second duct and means for controlling the movement of said stem from a position closing said second duct to a position opening said second duct, said means for controlling being partially located on the exterior of said housing.

3. The device of claim 2 wherein said means for controlling comprises a push button mounted on the exterior of said housing, and extending through said housing, said button operatively connected to said stem.

4. The device of claim 3 wherein said housing includes an aperture and said push button includes a shoulder designed to engage an edge of said aperture, said push button extending through said aperture and being spring-biased.

5. The device of claim 6 wherein said means for controlling comprises a handle, a one-armed, spring-biased lever disposed in said handle and connected to said valve stem and an operating member attached to said lever and projecting out of said handle.

* * * * *